US011686310B2

(12) United States Patent
Thomes

(10) Patent No.: US 11,686,310 B2
(45) **Date of Patent: *Jun. 27, 2023**

(54) METHOD FOR CONTROLLING A ROTARY SCREW COMPRESSOR

(71) Applicant: GARDNER DENVER DEUTSCHLAND GMBH, Bad Neustadt (DE)

(72) Inventor: Ulrich Thomes, Kuelz (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/536,562

(22) Filed: Nov. 29, 2021

(65) Prior Publication Data

US 2022/0082100 A1 Mar. 17, 2022

Related U.S. Application Data

(63) Continuation of application No. 15/950,099, filed on Apr. 10, 2018, now Pat. No. 11,193,489.

(30) Foreign Application Priority Data

Apr. 10, 2017 (DE) ..... 102017107601.8

(51) Int. Cl.
*F04C 28/08* (2006.01)
*F04C 28/24* (2006.01)
(Continued)

(52) U.S. Cl.
CPC ..... *F04C 28/08* (2013.01); *F04C 18/16* (2013.01); *F04C 23/003* (2013.01); *F04C 28/02* (2013.01);
(Continued)

(58) Field of Classification Search
CPC ..... F04C 18/16; F04C 23/003; F04C 28/02; F04C 28/06; F04C 28/24; F04C 28/08;
(Continued)

(56) References Cited

U.S. PATENT DOCUMENTS 4,212,599 A 7/1980 Lantermann
4,362,462 A 12/1982 Blotenberg
(Continued)

FOREIGN PATENT DOCUMENTS

CN 1402814 A 3/2003
CN 101033749 A 9/2007
(Continued)

OTHER PUBLICATIONS

European Patent Office Search Report for Application No. 18164781.9, dated Aug. 9, 2018 (8 pages, statement of relevance included).
(Continued)

*Primary Examiner* — Charles G Freay
(74) *Attorney, Agent, or Firm* — Kevin E. West; Advent, LLP

(57) ABSTRACT

The invention relates to a method for controlling a rotary screw compressor, having at least a first and a second air-end, wherein both air-ends are driven separately from one another and speed controlled. According to the invention, the following steps are carried out: detection of a volume flow taken at the outlet of the second air-end; adjustment of the rotational speed of both air-ends, when the removed volume flow fluctuates in a range between a maximum value and a minimum value; opening of a pressure-relief valve, if the volume flow falls below the minimum value; and reduction of the rotational speed of at least the first air-end to a predetermined idling speed ($V1_L$) to reduce the volumetric flow delivered by the first to the second air-end.

20 Claims, 2 Drawing Sheets

(51) Int. Cl.

| | |
|---|---|
| ***F04C 18/16*** | (2006.01) |
| ***F04C 23/00*** | (2006.01) |
| ***F04C 28/06*** | (2006.01) |
| ***F04C 28/02*** | (2006.01) |

(52) U.S. Cl.
CPC ..... *F04C 28/06* (2013.01); *F04C 28/24* (2013.01); *F04C 2240/402* (2013.01); *F04C 2270/02* (2013.01); *F04C 2270/052* (2013.01); *F04C 2270/18* (2013.01); *F04C 2270/20* (2013.01); *F04C 2270/44* (2013.01)

(58) Field of Classification Search
CPC ..... F04C 2240/402; F04C 2270/02; F04C 2270/052; F04C 2270/18; F04C 2270/20; F04C 2270/44
See application file for complete search history.

(56) References Cited

U.S. PATENT DOCUMENTS

| | | | | |
|---|---|---|---|---|
| 4,403,920 | A * | 9/1983 | Lantermann | F04C 28/24 417/295 |
| 6,068,447 | A | 5/2000 | Foege | |
| 6,095,194 | A | 8/2000 | Minato et al. | |
| 6,210,132 | B1 | 4/2001 | Shiinoki et al. | |
| 6,302,236 | B1 | 10/2001 | Choyce | |
| 6,345,960 | B1 | 2/2002 | Persson et al. | |
| 6,595,757 | B2 | 7/2003 | Shen | |
| 6,739,841 | B2 | 5/2004 | Nishimura et al. | |
| 6,802,696 | B1 | 10/2004 | Verhaegen | |
| 7,118,348 | B2 | 10/2006 | Dean et al. | |
| 7,922,457 | B2 | 4/2011 | Lindsey et al. | |
| 7,925,385 | B2 | 4/2011 | Stavale et al. | |
| 8,241,009 | B2 | 8/2012 | Platteel et al. | |
| 8,616,856 | B2 | 12/2013 | Matsuzaka et al. | |
| 9,057,374 | B2 | 6/2015 | Fujimoto et al. | |
| 9,328,731 | B2 | 5/2016 | Yabe et al. | |
| 11,193,489 | B2 * | 12/2021 | Thomes | F04C 28/02 |
| 2004/0101411 | A1 | 5/2004 | Nichol et al. | |
| 2006/0204371 | A1 | 9/2006 | Rexhauser et al. | |
| 2006/0280626 | A1 | 12/2006 | Nishimura et al. | |
| 2007/0189905 | A1 | 8/2007 | Dinsdale et al. | |
| 2007/0212229 | A1 | 9/2007 | Stavale et al. | |
| 2008/0240953 | A1 * | 10/2008 | Kimura | F04C 28/08 417/1 |
| 2009/0304522 | A1 * | 12/2009 | Lelong | F04B 41/06 417/5 |
| 2010/0303658 | A1 | 12/2010 | Ito et al. | |
| 2013/0039737 | A1 | 2/2013 | Huberland et al. | |
| 2013/0136643 | A1 | 5/2013 | Yabe et al. | |
| 2013/0287592 | A1 * | 10/2013 | Kobayashi | F04C 18/0207 417/2 |
| 2015/0337845 | A1 | 11/2015 | Wenzel | |
| 2016/0097389 | A1 | 4/2016 | Yamazaki et al. | |
| 2016/0319809 | A1 | 11/2016 | Huetter | |
| 2017/0321699 | A1 | 11/2017 | Kawano et al. | |
| 2018/0030984 | A1 | 2/2018 | Sato et al. | |
| 2019/0264967 | A1 * | 8/2019 | Ju | F04C 23/001 |

FOREIGN PATENT DOCUMENTS

| | | | |
|---|---|---|---|
| DE | 1628835 | A1 | 6/1971 |
| DE | 2909675 | C3 | 11/1981 |
| DE | 2737677 | C2 | 5/1984 |
| DE | 9014888 | U1 | 1/1991 |
| DE | 10003869 | A1 | 8/2001 |
| DE | 69818687 | T2 | 4/2004 |
| DE | 69920997 | T2 | 3/2006 |
| DE | 60117821 | T2 | 11/2006 |
| DE | 102006020334 | A1 | 10/2007 |
| DE | 10003869 | C5 | 11/2007 |
| DE | 102014107126 | A1 | 11/2015 |
| DE | 102016100140 | A1 | 7/2017 |
| EP | 0243559 | A1 | 11/1987 |
| EP | 1703618 | A1 | 9/2006 |
| EP | 1934476 | A1 | 6/2008 |
| EP | 2886862 | A1 | 6/2015 |
| FR | 2713702 | A1 | 6/1995 |
| JP | H03108818 | U | 11/1991 |
| JP | 2008133811 | A | 6/2008 |
| WO | 2011130807 | A2 | 10/2011 |
| WO | 2012026317 | A1 | 3/2012 |
| WO | 2016129366 | A1 | 8/2016 |

OTHER PUBLICATIONS

European Patent Office Search Report for Application No. 18164785.0, dated Sep. 5, 2018 (11 pages, statement of relevance included).
European Patent Office Search Report for Application No. 18164786.8, dated Jul. 13, 2018 (8 pages, statement of relevance included).
Examination Reportfor Indian Patent Application No. 201814011851, dated Jul. 13, 2021.
German Patent Office Examination Report for Application No. 102017107599.2, dated Feb. 5, 2018 (7 pages, statement of relevance included).
German Patent Office Examination Report for Application No. 102017107601.8, dated Dec. 18, 2018 (7 pages, statement of relevance included).
German Patent Office Examination Report for Application No. 102017107602.6, dated Feb. 5, 2018 (6 pages, statement of relevance included).
Konka, "Schraubenkompressoren Technik und Praxis," VDI-Verlag GmbH, Dusseldorf, 1988, pp. 250-251, pp. 322-335, see pp. 332 et seq.; (statement of relevance included).
Office Action for Chinese Application No. 201810310806.9, dated Oct. 10, 2020.

* cited by examiner

| | |
|---|---|
| Motor speed | max |
| Volume flow | max |
| Output KW | 150 |
| Pressure Ratio Incorporated | 3.2 |
| Speed Ratio | 1.4 |
| Pressure (bar absolute) max | 12.0 |
| Pressure (bar absolute) min | 6.0 |
| Temp °C | 35 |
| Pressure (bar absolute) design | 10.2 |
| Temp °C | 180 |
| Speed 2nd stage [1/min] | 22,000 |
| Temp °C | 30 |
| Pressure (bar absolute) | 3.2 |
| Temp °C | 170 |
| Speed 1st stage[1/min] | 15,500 |
| Pressure (bar absolute) | 1.0 |
| Pressure (bar absolute) | 1.0 |
| Temp °C | 20 |

| | |
|---|---|
| Motor speed | min |
| Volume flow | min |
| Output KW | 7 |
| Pressure Ratio Incorporated | 3.2 |
| Speed Ratio | 3.0 |
| Pressure (bar absolute) max | 1.2 |
| Pressure (bar absolute) min | 1.0 |
| Temp °C | 30 |
| Pressure (bar absolute) design | 1.2 |
| Temp °C | 70 |
| Speed 2nd stage [l/min] | 7,500 |
| Temp °C | 30 |
| Pressure (bar absolute) | 1.5 |
| Temp °C | 90 |
| Speed 1st stage[l/min] | 2,500 |
| Pressure (bar absolute) | 1.0 |
| Pressure (bar absolute) | 1.0 |
| Temp °C | 20 |

METHOD FOR CONTROLLING A ROTARY SCREW COMPRESSOR

CROSS-REFERENCE TO RELATED APPLICATIONS

This application is a continuation under 35 U.S.C. § 120 of U.S. patent application Ser. No. 15/950,099, filed Apr. 10, 2018, and titled "METHOD FOR CONTROLLING A ROTARY SCREW COMPRESSOR", which in turn claims priority to German Patent Application No. DE102017107601.8, filed with the German Patent Office on Apr. 10, 2017. German Patent Application No. DE102017107601.8 and U.S. patent application Ser. No. 15/950,099 are herein incorporated by reference in their entireties.

BACKGROUND

The invention relates to a method for controlling a rotary screw compressor, in particular a rotary twin screw compressor in idle mode. Such a rotary screw compressor has at least a first and a second air-end, wherein the first air-end compresses a gaseous medium, usually air, and leads to the second air-end, which further compresses the medium and delivers it to a downstream system. The method of the inventive is suitable for the control of directly driven rotary screw compressors, in which both air-ends are driven separately from one another and speed controlled. The invention also relates to a compressor with a rotary twin screw compressor which is controlled by this method in idle mode.

For compression of gaseous media, in particular for the production of compressed air, a variety of compressor designs are known. For example, DE 601 17 821 T2 shows a multi-stage rotary screw compressor with two or more air-ends, each air-end comprising a pair of rotors for compressing a gas. Furthermore, two or more variable speed drive means are provided, wherein each drive means powers a respective air-end. A control unit controls the speeds of the drive means, monitoring the torque and speed of each drive means so that the rotary screw compressor provides gas at a required flow delivery rate and pressure, while minimizing power consumption of the rotary screw compressor.

In practical use of such multi-stage rotary screw compressor, so-called idling occurs as an operating condition. In this case, no compressed air is taken from the downstream system, so that the delivery of additional medium must be adjusted to avoid an increase in pressure. Nevertheless, the compressor should not be switched off completely when idling, if a short-term re-supply of compressed air has to be reckoned with. In order to enable this idle mode, usually a throttle valve is closed in the suction line and supplied via a bypass only a partial flow of the first air-end. These functions are usually carried out by a so-called intake regulator, which is arranged at the inlet of the first air-end. At the same time on the output side, that is to say, at the outlet of the second air-end, a blow-off valve opens to the atmosphere, so that the second air-end assists against atmospheric pressure. The pressure conditions in both air-ends remain the same, as a result of which the outlet temperatures of both stages remain virtually the same. The relatively high energy consumption of the compressor is a disadvantage of this idle control. In addition, there is a high design complexity for the intake regulator and its control. (see Konka, K.-H., rotary screw compressors: Technik and Praxis [Technology and Practice], VDI-Publications 1988, ISBN 3-18-400819-3, page 332 ff.)

In DE 100 03 869 C5, a method for compressing fluid media to be pumped in a rotary screw compressor system with two rotary screw compressor units is described. In this case, the outlet of the upstream screw compressor unit is connected to the inlet of the downstream screw compressor unit, and each rotary screw compressor unit is driven by its own drive unit. At least part of the operating parameters of the two rotary screw compressor units are detected and processed, and the drive units are controlled via the detected operating parameters of the rotary screw compressor units.

By means of the change in the operating parameters of the drive units, in particular current consumption, voltage absorption or fuel supply, the rotational speed of the upstream rotary screw compressor unit is correlated with the rotational speed of the downstream rotary screw compressor unit in such a way that in that the final outlet pressure or the final delivery rate of the rotational screw compressor unit is kept constant, and/or the total power consumption of the rotary screw compressor unit is minimized, or a maximum final outlet pressure or a maximum final delivery volume is achieved for a given total power consumption. However, this control method does not provide any information for optimizing idle mode of the system and resulting energy savings.

SUMMARY

One object of the present invention is therefore to provide an improved method of controlling a rotary twin screw compressor that allows for safe idle mode, while reducing the energy consumption of the compressor. In addition, the design complexity of the complete rotary screw compressor should be reduced, resulting in a cost reduction in its manufacture being derived.

These and other objects are achieved by a method of controlling a rotary screw compressor according to the appended claim 1. The sub-claims specify some preferred embodiments. In addition, the invention provides a compressor of the rotary twin screw compressor sort, which can be operated by this method.

Surprisingly, it has been found that both a significant reduction in energy consumption, and a simplification of the structure of the entire system, can be achieved by changing the control of the directly driven air-ends of the rotary screw compressor in idle mode.

The method of the invention serves to control a rotary screw compressor, having at least a first and a second air-end, wherein the first air-end compresses a gaseous medium, and leads to the second air-end, which further compresses the medium. The first air-end is thus seen in the flow direction of the medium before the second air-end. In most cases, such screw compressors have exactly two air-ends, but designs with more than two stages are also possible. Furthermore, it is necessary for the execution of the method that both air-ends be driven separately from each other and speed controlled driven, that is to say, each air-end is driven by a variable speed drive, in particular by a direct drive, so that a transfer case can be dispensed with.

In a first step of the method, a volume flow of the compressed gaseous medium, which is decreased at the outlet of the second air-end or delivered to downstream units, is detected with a suitable sensor. In this case, a direct volume flow measurement can be used or the removed volume flow is indirectly determined, for example, from the prevailing pressure conditions at the output of the second air-end, or from the torque/drive current occurring at the drive of the second air-end.

In normal load operation, a volume flow is decreased, which can vary between a maximum value for which the rotary screw compressor is designed, and a predetermined minimum value. In this load operation, the rotary screw compressor is controlled in a conventional manner, which also includes the possibility of the speed of the drives of the two air-ends being varied in a predetermined range. If the volume flow decreases in a range between a maximum value and a predetermined minimum value during load operation, the controller reduces the speed of both air-ends, and as the volume flow in this range increases again, the controller increases the speed of the air-ends again, so that a predetermined outlet pressure is maintained during normal load operation.

If, however, the volume flow falls below the predetermined minimum value, that is to say, no or only a very small volume flow is removed, the operating state of the rotary screw compressor changes from load operation to idle mode. For this purpose, in the next step of the method, a pressure-relief valve is opened in order to at least partially allow the volume flow initially supplied by the second air-end to be discharged via the pressure-relief valve. This prevents the pressure at the outlet of the rotary screw compressor from exceeding a maximum permissible size. The pressure-relief valve may be, for example, a controlled solenoid valve.

In a further step, which is preferably carried out with only a slight delay or substantially simultaneously with the opening of the pressure-relief valve, the speed of at least the first air-end is reduced to a predetermined idling speed V1L, in order to reduce the volumetric flow delivered by the first to the second air-end.

Deviating from the prior art, a throttle valve or an intake regulator is currently not closed for this purpose. Rather, the inlet of the first air-end remains fully open. A throttle valve or an intake regulator and their control can be completely eliminated. The reduction of the volume flow delivered by the first air-end preferably takes place exclusively via the reduction of the rotational speed of the first air-end of the idling speed V1L.

According to a preferred embodiment, the speed of the second air-end is reduced to an idling speed V2L in a next step. Preferably, the rotational speeds of both air-ends are substantially parallel, running respectively reduced to the idling speed V1L or V2L.

The idling speed V1L of the first air-end (Low Pressure—LP) is selected in coordination with the idling speed V2L of the second air-end (High Pressure—HP), in that the outlet temperature of the medium at the second stage does not become lower than the inlet temperature at this stage. Such an undesired operating condition may occur when the pressure ratio at the second air-end becomes smaller than 0.6. By choosing the idling speeds, it must therefore be ensured that the second stage does not work as an "expander," and that the temperature of the medium drops as a result. Otherwise, undesirable condensation in the compressor may occur. Furthermore, when choosing the idling speeds, it must be ensured that the second air-end is not driven by the transported medium from the first air-end. Otherwise, the second stage drive would switch to generator mode, which could result in damage to the drive that powers it.

The minimum idling speeds are also determined by which deceleration is acceptable on re-entry into the load condition. The shorter this return time, the higher the idling speed will have to be.

The idling speed ratio is preferably between the second and first stage in the range of 2 to 3, more preferably about 2.5. The pressure ratio of the first stage is about 1.5, and the pressure ratio of the second stage is approximately in the range of 0.6 to 0.75. The idling speed V2L of the second air-end is preferably about ½ to ¼ of the load speed of this stage. The idling speed V1L of the first air-end is preferably about ⅕ to ⅛ of the load speed of this stage.

An advantage of this control method is thus that both air-ends can be operated in idle mode at significantly lower rotational speeds. This reduces energy consumption and wear. In addition, the temperatures of the compressed medium at the outlet of the respective air-end drop, which also has an advantageous effect. Nevertheless, the rotary screw compressor can be brought back into the load mode very quickly when the volume flow is demanded again, by the rotational speeds of the air-ends being raised again.

The compressor provided by the invention for compressing gaseous media comprises a rotary screw compressor, having at least a first and a second air-end, wherein the first air-end compresses the gaseous medium and leads to the second air-end, which further compresses the medium, and wherein both air-ends are driven separately and speed controlled.

The compressor further comprises a control unit configured to carry out the method described above.

In particular, the compressor is characterized in that the inlet of the fluidic front, first air-end, is guided without a volume flow limiting, controllable throttle element, or without an intake regulator to the ambient atmosphere. The compressor has a pressure-relief valve at the outlet of the fluidic rear, second air-end, which is determined by the control unit for opening, when the volume flow decreases below a predetermined minimum value.

BRIEF DESCRIPTION OF THE DRAWINGS

Further advantages and details emerge from the following description of a preferred embodiment with reference to the drawing. Shown are.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

Figure 1:
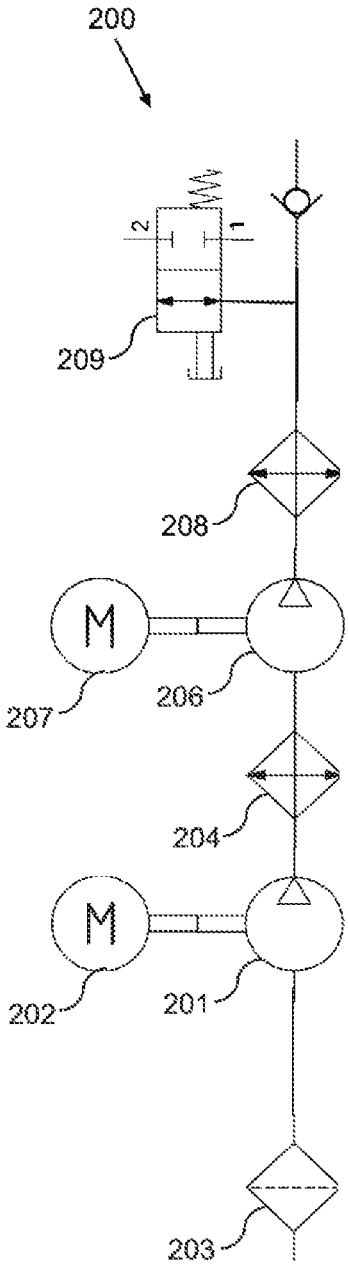
FIG. 1 illustrates a simplified representation of the operating parameters in a rotary screw compressor with two air-ends during load operation

FIG. 1 shows the basic structure of a compressor, which is designed as a rotary twin screw compressor 200. In addition to the individual elements of the rotary twin screw compressor, typical parameters are also given, how they occur during load operation, if compressed air with a volume flow above a predetermined minimum value and not greater than a system-dependent maximum value is required.

A first air-end 201 has a first direct drive 202 which is speed-controlled. The inlet of the first air-end 201, via which ambient air is drawn in, is coupled without the interposition of an intake regulator directly to an intake manifold 203, at which ambient atmosphere with a pressure of 1.0 bar at a temperature of, for example, 20° C. is applied. Thus, at the inlet of the first air-end 201, a pressure of 1.0 bar is applied.

The first air-end 201 is operated, for example, at a speed of 15,500 min−1 in order to compress the air. At the outlet of the first air-end 201, a pressure of 3.2 bar prevails, so that the first air-end has a compression ratio of 3.2 during load operation. Through the compression the temperature of the medium (compressed air) increases to 170° C. The compressed air is conducted from the outlet of the first air-end 201 via an inter-stage cooler 204 to the inlet of a second air-end 206, which has a second, speed-controlled direct drive 207. After the inter-stage cooler 204, at the inlet of the second air-end 206, the compressed air has a temperature of, for example, 30° C. and further a pressure of 3.2 bar. In load operation, the second air-end 206 with a speed of, for example, 22,000 min−1 is operated, so that it comes to a further compression. The compressed air therefore has a pressure of 10.2 bar and a temperature of 180° C. at the outlet of the second air-end 206. The second air-end thus also has a compression ratio of about 3.2. The compressed air is passed from the outlet of the second air-end 206 through an after-cooler 208 and cooled there to about 35° C. Finally, at the output of the rotary twin screw compressor 200, a pressure-relief valve 209 is arranged, which is actuated by a control unit (not shown).

The rotary twin screw compressor 200, described by way of example, exhibits a power consumption of 150 kW at maximum rotational speed to the direct drives 202, 207, and supplies compressed air with a maximum pressure of 12 bar and a minimum pressure of 6 bar. The speed ratio between the air-ends is approximately 1.4 during load operation.

Figure 2:
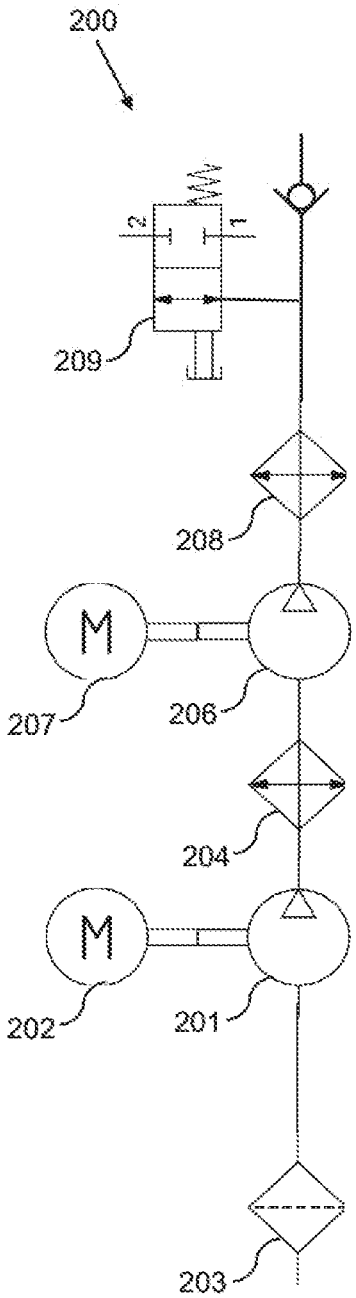
FIG. 2 illustrates a simplified illustration of the operating parameters in the rotary screw compressor during idle mode.

FIG. 2 shows the rotary twin screw compressor 200 in idle mode, that is, if essentially no compressed air is removed. In addition to the elements of the rotary twin screw compressor, typical parameters are given in turn, as they occur in idle mode. To enter into idle mode, the pressure-relief valve is opened and the speed of both air-ends is reduced. The inlet of the first air-end 201, via which ambient air continues to be sucked in, albeit in a reduced amount, is still coupled without the interposition of an intake regulator directly to the intake manifold 203, at which ambient atmosphere is applied at a pressure of 1.0 bar at a temperature of 20° C. At the inlet of the first air-end 201, an unchanged pressure of 1.0 bar is thus applied.

The first air-end 201 is now operated at an idling speed V1L=2,500 min−1 in order to compress the air. At the outlet of the first air-end 201, a pressure of 1.5 bar prevails, so that the first air-end has a compression ratio of 1.5 in idle mode. Due to the reduced compression, the temperature of the medium (compressed air) only increases to 90° C. The compressed air is supplied from the outlet of the first air-end 201 via the inter-stage cooler 204 led to the inlet of the second air-end 206. After the inter-stage cooler 204, at the inlet of the second air-end 206, the compressed air has at idle a temperature of, for example, 30° C. and further a pressure of 1.5 bar. After the intercooler 204, at the inlet of the second compressor stage 206, the compressed air has at idle a temperature of for example 30° C. and further a pressure of 1.5 bar (Intermediate pressure). The necessary cooling capacity for the intermediate cooling is thus reduced during idle mode. In idle mode, the second air-end 206 is operated at an idling speed V2L of 7,500 min−1 rpm. At the outlet of the second air-end 206, the compressed air has a reduced pressure of about 1.2 bar and a temperature of 70° C., compared to the intermediate pressure. The second air-end thus has a compression ratio of about 0.8 (Expansion). The compressed air is passed from the outlet of the second air-end 206 through the after-cooler 208 and cooled there to about 30° C.

The rotary twin screw compressor 200, described by way of example, exhibits a power consumption of 7 kW during idle mode and delivers a maximum pressure of 1.2 bar. The speed ratio between the air-ends is about 3.

REFERENCE NUMERAL LIST

200 Rotary twin screw compressor
201 First rotary screw compressor
202 First direct drive
203 Intake air duct
204 Inter-stage cooler
205 —
206 Second rotary screw compressor
207 second direct drive
208 After-cooler
209 Pressure-relief valve Various features and advantages of the disclosure are set forth in the following claims.

What is claimed is:

1. A rotary screw compressor, comprising:
a first air-end configured to compress a gaseous medium;
a second air-end configured to further compress the gaseous medium;
a first variable speed drive configured to drive the first air-end;
a second variable speed drive configured to drive the second air-end; and
a control unit communicatively coupled with each of the first variable speed drive and the second variable speed drive, the control unit configured to
determine a flow of the compressed gaseous medium at an outlet of the second air-end;
adjust a rotation speed of the first air-end with the first variable speed drive when the flow fluctuates in a range between a maximum value and a predetermined minimum value, while maintaining a predetermined outlet pressure;
adjust a rotational speed of the second air-end with the second variable speed drive when the flow fluctuates in the range between the maximum value and the predetermined minimum value, while maintaining the predetermined outlet pressure; and
reduce the rotational speed of the first air-end to a predetermined idling speed via the first variable speed drive when the flow falls below the predetermined minimum value to reduce the flow delivered by the first air-end to the second air-end, wherein a speed ratio between the second air-end and the first air-end when the flow determined at the outlet of the second air-end fluctuates in a range between the maximum value and the predetermined minimum value is different than the speed ratio between the second air-end and the first air-end when the flow determined at the outlet of the second air-end falls below the predetermined minimum value.

2. The rotary screw compressor of claim 1, wherein the control unit is further configured to reduce the rotational speed of the second air-end to a second predetermined idling speed via the second variable speed drive when the flow falls below the predetermined minimum value.

3. The rotary screw compressor of claim 2, wherein a ratio of the second predetermined idling speed of the second air-end to the predetermined idling speed of the first air-end is within a range from 2 to 3.

4. The rotary screw compressor of claim 1, wherein an inlet of the first air-end is in direct communication with an atmosphere in which the rotary screw compressor is positioned.

5. The rotary screw compressor of claim 1, further comprising a volumetric flow sensor communicatively coupled with the control unit, the volumetric flow sensor configured to measure the flow of the compressed gaseous medium at the outlet of the second air-end.

6. The rotary screw compressor of claim 1, further comprising a pressure-relief valve in fluid communication with the outlet of the second air-end.

7. The rotary screw compressor of claim 6, wherein the control unit is further configured to open the pressure-relief valve when the flow falls below the predetermined minimum value to at least partially discharge compressed gaseous medium delivered by the second air-end via the pressure-relief valve.

8. A rotary screw compressor, comprising:

a first air-end configured to compress a gaseous medium;

a second air-end configured to further compress the gaseous medium;

a first variable speed drive configured to drive the first air-end;

a second variable speed drive configured to drive the second air-end;

a pressure-relief valve in fluid communication with an outlet of the second air-end; and a control unit communicatively coupled with the first variable speed drive, the second variable speed drive, and the pressure-relief valve, the control unit configured to determine a flow of the compressed gaseous medium at the outlet of the second air-end;

adjust a rotation speed of the first air-end with the first variable speed drive when the flow fluctuates in a range between a maximum value and a predetermined minimum value;

adjust a rotational speed of the second air-end with the second variable speed drive when the flow fluctuates in the range between the maximum value and the predetermined minimum value; and reduce the rotational speed of the first air-end to a predetermined idling speed via the first variable speed drive when the flow falls below the predetermined minimum value to reduce the flow delivered by the first air-end to the second air-end, wherein a speed ratio between the second air-end and the first air-end when the flow determined at the outlet of the second air-end fluctuates in a range between the maximum value and the predetermined minimum value is different than the speed ratio between the second air-end and the first air-end when the flow determined at the outlet of the second air-end falls below the predetermined minimum value.

9. The rotary screw compressor of claim 8, wherein the control unit is further configured to reduce the rotational speed of the second air-end to a second predetermined idling speed via the second variable speed drive when the flow falls below the predetermined minimum value.

10. The rotary screw compressor of claim 9, wherein a ratio of the second predetermined idling speed of the second air-end to the predetermined idling speed of the first air-end is within a range from 2 to 3.

11. The rotary screw compressor of claim 8, wherein an inlet of the first air-end is in direct communication with an atmosphere in which the rotary screw compressor is positioned.

12. The rotary screw compressor of claim 8, further comprising a flow sensor communicatively coupled with the control unit, the flow sensor configured to measure the flow of the compressed gaseous medium at the outlet of the second air-end.

13. The rotary screw compressor of claim 8, wherein the control unit is further configured to open the pressure-relief valve when the flow falls below the predetermined minimum value to at least partially discharge compressed gaseous medium delivered by the second air-end via the pressure-relief valve.

14. The rotary screw compressor of claim 8, wherein the control unit is further configured to control operation of at least one of the first variable speed drive or the second variable speed drive to maintain a predetermined outlet pressure when the flow fluctuates in the range between the maximum value and the predetermined minimum value.

15. The rotary screw compressor of claim 8, wherein at least one of the first variable speed drive or the second variable speed drive is a speed-controlled direct drive.

16. A rotary screw compressor, comprising:

a first air-end and a second air-end, the first air-end configured to compress a gaseous medium, the second air-end configured to further compress the gaseous medium, wherein each of the first air-end and the second air-end is driven separately and speed controllable;

a pressure-relief valve in fluid communication with an outlet of the second air-end; and a control unit configured to determine a flow of the compressed gaseous medium at an outlet of the second air-end;

adjust a rotation speed of the first air-end when the flow fluctuates in a range between a maximum value and a predetermined minimum value, while maintaining a predetermined outlet pressure;

adjust a rotational speed of the second air-end when the flow fluctuates in the range between the maximum value and the predetermined minimum value, while maintaining the predetermined outlet pressure;

open the pressure-relief valve when the flow falls below the predetermined minimum value to at least partially discharge compressed gaseous medium delivered by the second air-end via the pressure-relief valve; and reduce the rotational speed of the first air-end to a predetermined idling speed when the flow falls below the predetermined minimum value to reduce the flow delivered by the first air-end to the second air-end, wherein a speed ratio between the second air-end and the first air-end when the flow determined at the outlet of the second air-end fluctuates in a range between the maximum value and the predetermined minimum value is different than the speed ratio between the second air-end and the first air-end when the flow determined at the outlet of the second air-end falls below the predetermined minimum value.

17. The rotary screw compressor of claim 16, wherein the control unit is further configured to reduce the rotational speed of the second air-end to a second predetermined idling speed when the flow falls below the predetermined minimum value.

18. The rotary screw compressor of claim 17, wherein a ratio of the second predetermined idling speed of the second air-end to the predetermined idling speed of the first air-end is within a range from 2 to 3.

19. The rotary screw compressor of claim 16, wherein an inlet of the first air-end is in direct communication with an atmosphere in which the rotary screw compressor is positioned.

20. The rotary screw compressor of claim 16, further comprising a flow sensor communicatively coupled with the control unit, the flow sensor configured to measure the flow of the compressed gaseous medium at the outlet of the second air-end.

* * * * *